United States Patent [19]

Fischer

[11] Patent Number: 4,916,916

[45] Date of Patent: Apr. 17, 1990

[54] ENERGY STORAGE APPARATUS AND METHOD

[76] Inventor: Harry C. Fischer, Rte. 665, Moon, Va. 23119

[21] Appl. No.: 270,211

[22] Filed: Nov. 14, 1988

[51] Int. Cl.[4] ..... F25B 5/00

[52] U.S. Cl. ..... 62/199; 62/430

[58] Field of Search ..... 62/199, 430, 431, 432, 62/433, 434, 435, 436, 437, 438

[56] References Cited

U.S. PATENT DOCUMENTS 4,637,219 1/1987 Grose ..... 62/430 X

*Primary Examiner*—Henry A. Bennet

*Attorney, Agent, or Firm*—David M. Carter

[57] ABSTRACT

There is provided a method and apparatus for storing energy and for utilizing the stored energy. The apparatus includes a storage container which holds a phase change energy storage material such as water. A plurality of coils are disposed in the storage container and carry a refrigerant material. At least one evaporator is connected to the coils. A self pumping apparatus is connected to a condensing unit, to the evaporator and to the coils, and is operated by the adiabatic conversion of refrigerant from its liquid state to a vapor plus liquid state. The self pumping apparatus thus moves the refrigerant fluid to the evaporator without the need for additonal energy input. The self pumping apparatus includes a pair of tanks each of which alternately operate as a pumper and as an accumulator during ice melting. During ice freezing, both containers operate as accmulators.

19 Claims, 4 Drawing Sheets

ENERGY STORAGE APPARATUS AND METHOD

BACKGROUND OF THE INVENTION

This invention relates to energy storage systems. More particularly it relates to systems for utilizing stored energy during peak demand periods.

This invention is an improvement over U.S. Pat. No. 4,735,064 issued Apr. 5, 1988 and invented by Harry Fischer and is hereby incorporated herein by reference.

The tank or container which is shown in the Fischer Patent to store energy during one time period, generally at night, and to supply energy during peak periods of energy use, generally in late afternoon, may also be used herein. Preferably the stored energy is used for cooling buildings during summer months.

There are primarily two practices commonly followed to avoid high utility demand charges during peak summer hours. One is called load shedding in which compressors are shut down during the peak periods and cooling is provided by stored energy, such as by using large tanks of chilled water or by melting large quantities of ice to provide cooling. The size of such systems is large because all of the cooling must be provided from storage. During charging periods, a large mechanical system must be used to recharge the system in the allotted off-peak charging period.

Another system used to reduce peak demand is called load leveling. In that case, a smaller mechanical package is required and a smaller energy storage tank is required. In the case of load leveling, the small mechanical package is designed to meet the peak day requirement by operating 24 hour per day. During night-time periods of low air conditioning loads, the excess capacity is used to build ice in an energy storage container. During daytime operation, the mechanical package or condensing unit operates to meet the cooling requirements of the building. When the cooling requirements are satisfied, the condensing unit continues to store more cooling. When the cooling load exceeds the capacity of the condensing unit, some of the stored energy in the form of ice is melted to condense some of the refrigerant to supplement the condensing unit capacity to meet the peak loads.

Ice freezing time of low air conditioning demand may be as long as 12–14 hours, contrasting to the peak demand hours, which may be as short as 3 hours or as long as 10 hours. This invention covers a novel load leveling system which, in conjunction with the Energy Storage Container described in the Fischer Patent, provides a simple, energy efficient, and low cost means of meeting the varying cooling loads required to satisfy the need of both residential and commercial buildings that are cooled by "direct expansion" cooling systems. While the system described in the Fischer patent also provides these results, it uses an electrical pump to move refrigerant during the peak demand and thus requires the use of electrical energy during that time.

OBJECTS OF THE INVENTION

One object of this invention is to provide an improved energy storage system capable of load leveling.

Another object of this invention is to provide a means of storing energy when condensing capacity exceeds cooling loads and a means to discharge stored energy when cooling loads exceed capacity of the condensing unit.

It is still another object to provide a cost efficient air conditioning system that is simple to install and control and operate.

It is another object to provide a system which efficiently moves refrigerant from an energy storage container to evaporation during peak demand.

SUMMARY OF THE INVENTION

In accordance with this invention, an energy storage container such as the one described in U.S. Pat. No. 4,735,064 may be used in conjunction with a self pumping mechanism to provide a means of pumping liquid refrigerant condensed inside the coils of an energy storage container, together with the liquid refrigerant condensed by the operating condensing unit, out to the evaporator coil or coils, where it is vaporized to cool the building in which the evaporator coils are located.

The vapor and liquid refrigerant returning to the energy storage container from the evaporators is partially condensed if its pressure is normally above a predetermined level such as 60 psi for Freon R-22 and the resulting liquid and vapor mix is collected in a first accumulator, preferably located in the storage container. The vapor separates from the liquid in the first accumulator and passes from the first accumulator to the compressor preferably via a spring-loaded, dual port pressure check valve (DPC).

When the first accumulator has been filling with separated liquid refrigerant for a period of time, a valve opens and the first accumulator, which has been at suction pressure during filling, is now subject to an intermediate pressure of about 30 psi above the pressure of the evaporator or the suction pressure. The higher pressure forces the accumulated liquid refrigerant out of the active evaporator(s) where cooling of air is accomplished.

In the meantime, a second valve closes and the second accumulator returns to suction pressure and is accumulating liquid refrigerant and allowing refrigerant vapor to go to the compressor to be compressed and condensed in the outdoor condensing coil.

Liquid refrigerant from the outdoor condenser is typically 225 psi pressure and 110° F. This liquid passes through an open valve and through an adiabatic expansion device, such as a capillary tube, forming flash gas and liquid refrigerant at a lower temperature. The remaining liquid refrigerant and flash gas exiting the capillary tube is at a pressure above evaporating pressure. The liquid at 110° F. contains more heat than does liquid at 58° F. (approximately 30 psi above the suction pressure), therefore the difference in heat content shows up as refrigerant vapor or flash gas. It is the flash gas that powers the self-pumper, which is what the combination of valves, accumulator, DPC valve and capillary tube is referred to. The volume of flash gas may be enough to normally pump approximately six times the amount of liquid condensed by the condensing unit under normal conditions.

The self-pumper provides the means of transferring the liquid refrigerant accumulated at suction pressure, which is condensed in the tubes surrounded by ice, to the evaporator at a pressure sufficient to overcome friction and head differences between the ice storage tank and the evaporator(s).

In accordance with one form of this invention there is provided a system for storing energy and for utilizing stored energy including a storage tank for receiving an energy storage material with a plurality of coils disposed in said storage tank. The coils contain a fluid which exists in liquid and vapor states. An evaporator is connected to the coils. A pumping apparatus is connected to a condensing unit, to the evaporator, and to the coils. The pumping apparatus is operated by the adiabatic conversion of liquid, received from the condensing unit, to flash gas and liquid at a lower temperature and at an intermediate pressure. The liquid is at high pressure and is adiabatically converted to flash gas at an intermediate pressure whereby the pumping apparatus moves fluid to the evaporator without the need for additional energy input.

In accordance with another form of this invention there is provided a method for regulating the temperature in a conditioned space utilizing a tank containing coils and energy storage material, and further utilizing a condensing unit, at least one evaporator, and at least one accumulator/pumper, including the steps of accumulating refrigerant liquid in a section of the accumulator/pumper, adiabatically converting at least a portion of refrigerant liquid received from the condenser from liquid to gas, contacting the gas with the refrigerant liquid in the accumulator/pumper, and forcing the liquid out of the accumulator/pumper to the evaporator or to the coils.

BRIEF DESCRIPTION OF THE DRAWINGS

The subject matter which is regarded as the invention is set forth in the appended claims. The invention itself, however, together with further objects and advantages thereof, may be better seen in reference to the following description taken in conjunction with the accompanying drawings in which:

DESCRIPTION OF THE PREFERRED EMBODIMENTS

Figure 1:
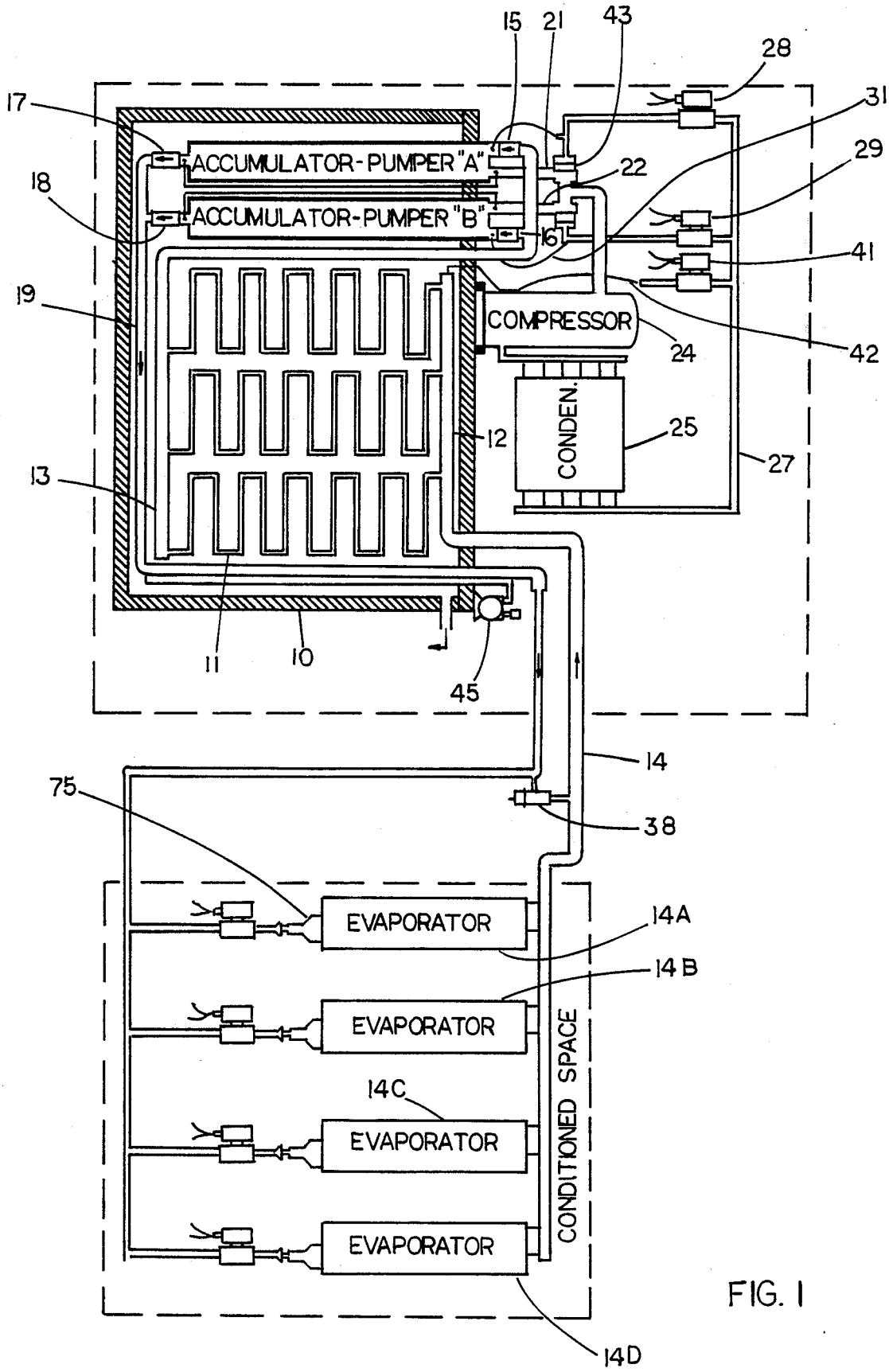
FIG. 1 is a schematic diagram of the apparatus of the subject invention with the energy storage tank shown in cross section.

Referring now more particularly to FIG. 1, there is provided an insulated tank 10, which contains coils of tubing 11 spaced on about 2-inch centers and connected by means of a top header 12 and a bottom header 13. The top header 12 is connected to the suction line 14 from the evaporators 14A, 14B and 14C. The bottom header 13 is connected to accumulator/pumpers A and B by check valves 15 and 16, respectively.

The outlets of accumulator/pumpers A and B are connected to check valves 17 and 18, respectively. Check valves 17 and 18 supply liquid refrigerant R-22 to liquid line 19, which supplies liquid to the evaporators generally located at a distance from tank 10. The liquid refrigerant is partially or completely vaporized in the evaporators and then travels through suction line 14, top header 12, coils 11, and bottom header 13 to the top of accumulator/pumper A or B where it passes through check valves 15 and 16, depending on which accumulator/pumper is at evaporator pressure.

Figure 2:
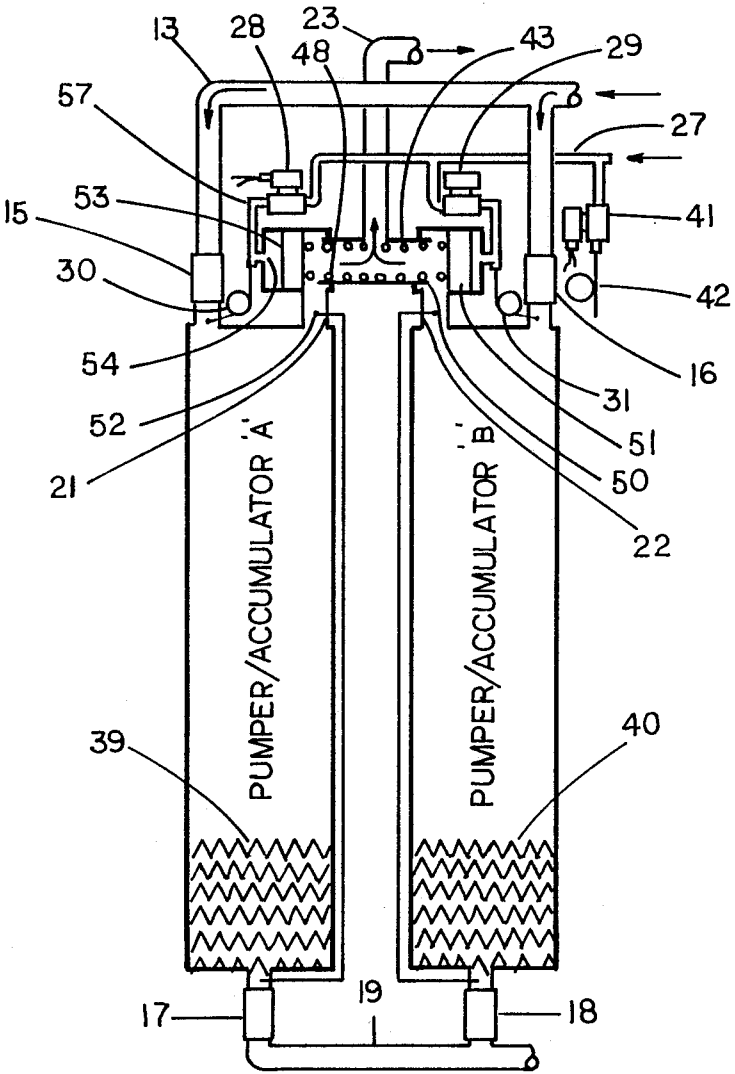
FIG. 2 is an enlarged sectional schematic view of the self pumper shown in FIG. 1 with the details of a dual port pressure check valve shown and with both pumper tanks at evaporator pressure during ice making.

Flow through the compressor 24, condenser 25, coils 11, headers 12 and 13, and lines 19 and 14 is in the direction of the arrows shown in FIG. 1. Compressor 24 is connected to condenser 25 which in turn is connected to line 27. The other side of compressor 24 is connected to dual port pressure check valve or DPC valve 43 through line 23. As shown in FIG. 2, DPC valve 43 includes pistons 51 and 53 which are connected together by springs 48. Pistons 51 and 53 alternately open and close openings 50 and 52 in the DPC valve which are respectively connected to accumulator/pumper B and accumulator/pumper A by means of tubes 22 and 21. DPC valve 43 also includes openings 54 and 56. Line 57 connects opening 54 to solenoid valve 28 which in turn is connected to line 27. Line 59 connects opening 56 to line 27 through solenoid valve 29. Capillary tube 30 connects line 57 to accumulator/pumper A. Capillary tube 31 connects line 59 to accumulator/pumper B. Line 27 is connected to capillary tube 42 through solenoid valve 41. Capillary tube 42 is in turn connected to header 12. The DPC valve, accumulator/pumpers A and B, and capillary tubes 30 and 31 form the primary components of the self pumper of the present invention.

Figure 3:
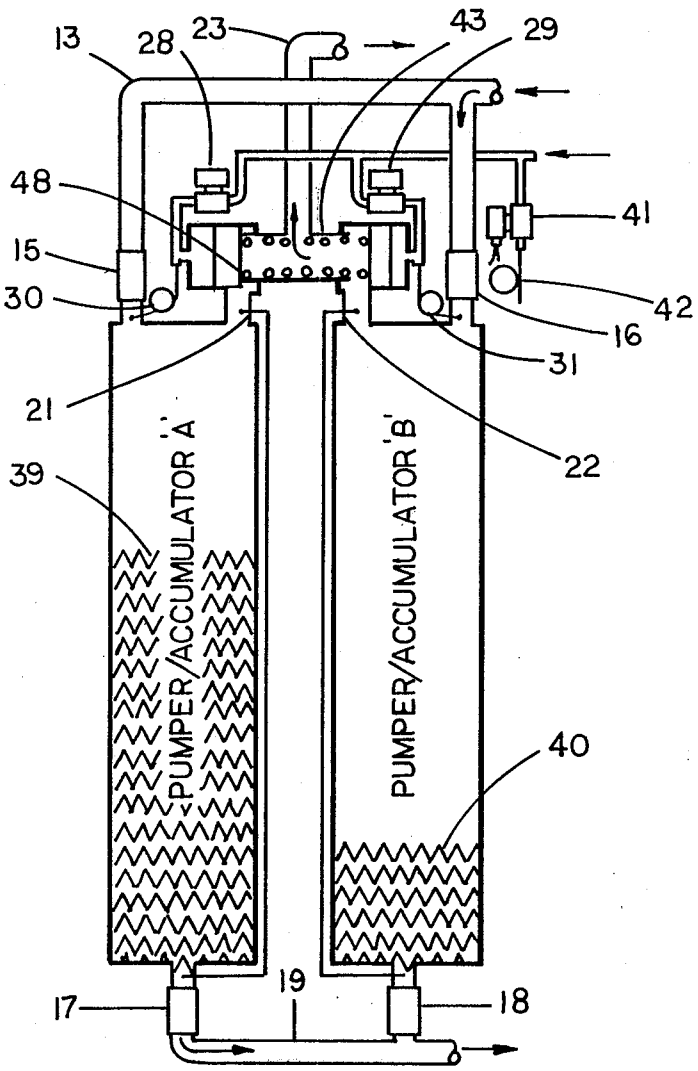
FIG. 3 is the same view as FIG. 2, except that one accumulator/pumper is at an intermediate pressure to force liquid refrigerant to evaporators when on cooling duty.
Figure 4:
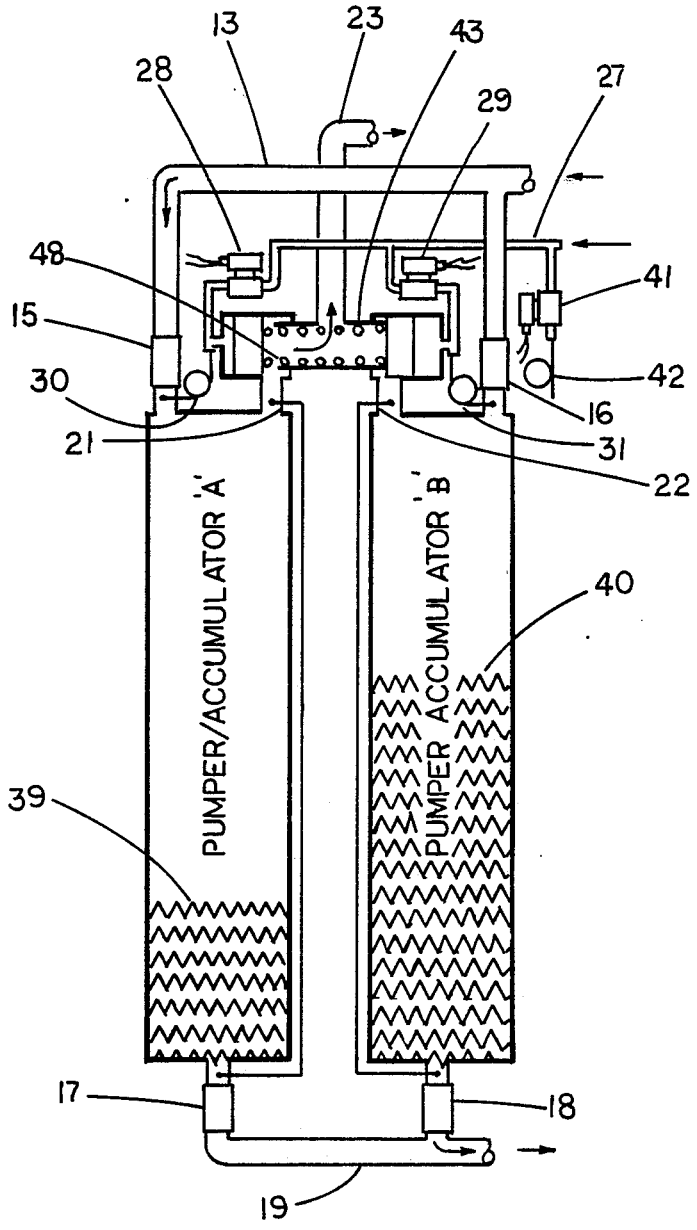
FIG. 4 is the same as FIG. 3, except the other accumulator/pumper is pressurized to force liquid refrigerant to the evaporators when cooling is required.
Figure 5:
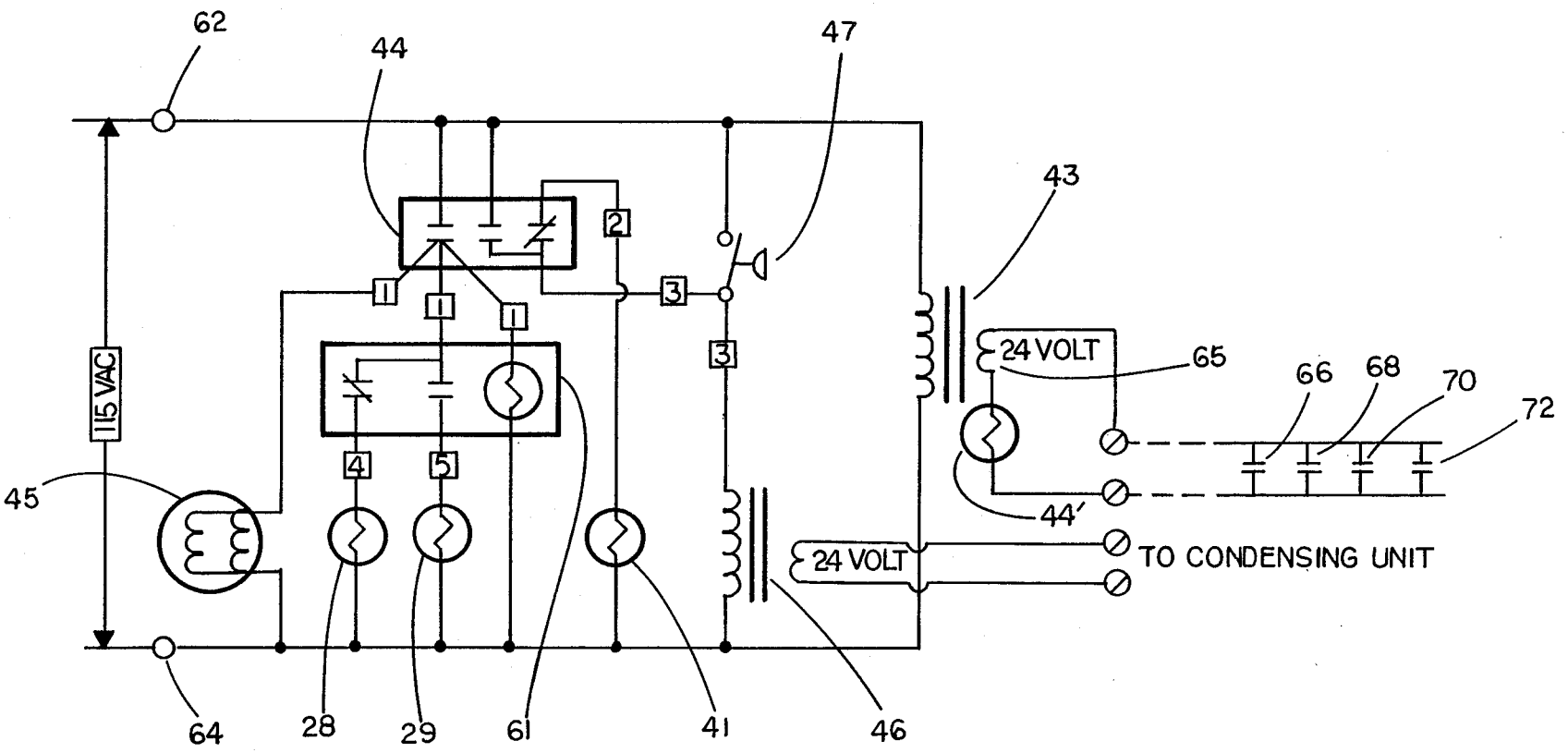
FIG. 5 is a schematic circuit diagram showing a system control with a timer to alternate the pressure in the accumulator/pumpers.

Referring now to FIG. 5, there is shown an electrical circuit which may be utilized to operate the various electrical components shown in FIGS. 1–4. Circuit 60 includes a pair of terminals 62 and 64 which are connected to a source of 115 volts. Air pump 45 is connected to cooling relay 44. Solenoids 28 and 29 are connected to timer 61 which in turn is connected to cooling relay 44. Ice solenoid 41 is connected to cooling relay 44. Cooling relay 44 is also connected to low pressure control switch 47 which in turn is connected to transformer 46. Transformer 46 is connected to condensing unit 25. Transformer 43 is connected across terminals 62 and 64 and is further connected to cooling relay 44. The low voltage side 65 of the transformer and cooling relay 44 are connected to zone cooling relays 66, 68, 70 and 72.

Reference is made to FIG. 2, which illustrates part of the self pumper operation.

There are two basic modes of operation of the system. One is ice freezing in tank 10, which occurs any time the conditioned space being cooled is not calling for cooling. Since the space temperature is controlled by an on-off thermostat, any time the thermostat is not calling for cooling, the system will revert to ice making until the ice tank 10 is full of ice.

During ice making, solenoid valves 28 and 29 are closed and solenoid valve 41 is open. Liquid refrigerant from line 27 flowing through solenoid valve 41 enters restrictor or capillary tube 42, where pressure is reduced from condensing pressure to evaporator pressure, which during ice making is below 57 psig when any ice is present on the tubes. A subcooling expansion valve or an automatic expansion valve can be used to control the refrigerant flow instead of capillary tube 42. Restrictive, capillary tubes and expansion valves are all considered adiabatic expansion devices and result in a mixture of flash gas and cold refrigerant liquid, which is fed to head 12 by coils 11 where it evaporates and picks up heat from water which turns to ice. This freezing action continues until the evaporator pressure drops to about 40 psig (18° F.), indicating about 90 percent ice.

The low pressure control switch 47 opens and compressor 24 stops running.

When one of the zone control relays 66, 68, 70, or 72 closes due to a zone thermostat calling for cooling, cooling relay 44 is energized and several things happen at once:

1. Solenoid valve 41 closes if ice making is still going on;
2. Transformer 46 is energized, sending a 24 volt signal to the remote condensing unit, including compressor 24 and fan of condenser 25 starts;
3. Air pump 45 starts; and
4. Repeat cycle timer 61 starts.

Either solenoid 28 or 29 is energized, depending on the starting position of the timer. FIG. 3 shows solenoid valve 28 open and solenoid valve 29 closed. In this condition, liquid refrigerant flows through solenoid valve 28 under the high pressure of the condenser 25 and piston 53 of DPC valve 43 closes opening 52. Liquid refrigerant from line 57 flows through restrictor or capillary tube 30 forming, in part, flash gas to accumulator/pumper A and accumulator/pumper A is pressurized to a pressure intermediate between condensing pressure and evaporating pressure which preferably is approximately 30 psi above evaporator pressure. The accumulated liquid in accumulator/pumper A is at some level 39 and under pressure. The accumulated liquid moves out of accumulator/pumper A, through check valve 17, to line 19 leading to remote evaporators 14A, 14B and/or 14C, whichever is calling for cooling. When the accumulated liquid is drained from accumulator/pumper A, flash gas and liquid that has flowed through solenoid valve 28 flows to line 19. Under normal circumstances, the timer 61 will reverse the accumulator/pumper A to lower pressure by closing solenoid valve 28 and opening solenoid valve 29 on about a one-minute cycle. As shown in FIG. 4, the valves are now reversed and the accumulator/pumper B is pressurized and piston 51 on the right of DPC valve 43 closes opening 50. Liquid refrigerant flows from line 59 through capillary tube 31 forming flash gas pressurizing accumulator/pumper B in the same manner and providing the same results as described above regarding accumulator/pumper A. Liquid refrigerant is pumped from accumulator/pumper B from accumulated level 40 to line 19 through check valve 18.

The reason for using the self pumper scheme is to provide a means of pumping liquid refrigerant which is at low side or evaporator pressure up to a pressure high enough to force it through the liquid line and the restrictor orifices to the evaporator. This pressure is about 20–40 psi greater than the evaporator pressure. The source of energy is the liquid refrigerant from the air cooled condenser, which is at a pressure 100 to 200 psi greater than evaporator pressure. The enthalpy of the warm 90° F.–120° F. R-22 liquid is higher than the enthalpy of 58° F. liquid flowing from the capillary tube operating at 98 psi. This difference in enthalpy appears as flash gas which does the pumping.

An example of this pumping operation under the following conditions is set forth below:

EXAMPLE 1

R-22 liquid from condenser: 110° F., 226.35 psig, $H_{liquid}$=42.446 Btu/lb, $H_{vapor}$=112.5 Btu/lb R-22 liquid at pumper pressure: 58° F., 98.0 psig, $H_{liquid}$=26.589 Btu/lb, $H_{vapor}$=109.564 Btu/lb R-22 liquid at evaporator pressure: 40° F., 68.5 psig, $H_{liquid}$=21.422 Btu/lb, $H_{vapor}$=108.14 Btu/lb (a) Pounds of liquid pumped per ton of refrigeration:

Enthalpy of vapor at 40° F. 108.14 Btu/lb

Enthalpy of liquid at $$110° \text{ F.} = 42.45 \text{ Btu/lb}$$
$$\Delta H = 65.69 \text{ Btu/lb}$$

12000 Btu/hr=1 ton R, therefore, $$\frac{12000}{65.69} = 182.67 \text{ lb/hr/ton } R$$

or, $$\frac{182.67}{60} = 3.045 \text{ lb/min/ton } R$$

(b) The passage of 3.04 lb of R-22 liquid through a cap tube is adiabatic. The difference in enthalpy of liquid is:

$$\text{liquid at } 110° \text{ F.} = 42.45 \text{ Btu/lb}$$
$$\text{liquid at } 58° \text{ F.} = 26.589 \text{ Btu/lb}$$
$$\Delta H = 15.86 \text{ Btu/lb}$$

This Δ H appears as flash gas in an adiabatic process, therefore, 3.04 lb/min×15.86 Btu/lb=48.22 Btu/min as flash gas.

At 98.0 psig, vapor occupies 0.48813 $ft^3$/lb and has a vapor enthalpy of 109.564 Btu/lb. The enthalpy of saturated liquid at 98.0 psi is 26.59 Btu/lb therefore, 48.22=0.581 lb/min of vapor is 109.564-26.589 produced and the volume of vapor produced is 0.581 lb/min×0.48813 $ft^3$/lb=0.2836 $ft^3$/min.

The weight of R-22 liquid at 58° F. is 76.773 lb/$ft^3$, therefore, 76.773×0.2836=21.77 lb of R-22 liquid can be forced from the pumper in one minute by the flash gas produced by 3.04 lb of liquid passing through the cap tube operating at 98.0 psig.

(c) The amount of liquid that can be pumped per minute is therefore 21.77=7.16 times the liquid condensed by a 3.04 one ton system.

This amount is far in excess of the volume required by a load leveling system, which is in the order of 2–3 times the amount of liquid produced by the operating condensing unit.

The above calculations in Example 1 show it should be possible to operate a self-pumper with only 14 percent of the liquid furnished by the condensing unit and 86 percent of the refrigeration or air conditioning capacity coming from storage.

By using a two-speed compressor operating at high speed during off-peak hours to freeze ice and provide direct cooling and by using low speed operation during peak demand hours, a reduction of up to 85 percent of normal electrical demand may be achieved over a conventional air conditioning system of the same instant capacity.

Due to the fact that accumulator/pumpers A and B are preferably located in the ice tank, part of the excess flash gas is condensed on the accumulator/pumper walls and is pumped out to line 19 as liquid refrigerant.

Whichever accumulator/pumper is not pressurized is at suction or evaporator pressure. The vapor and unevaporated liquid leaving the evaporator flow through line 14 to header 12 and thus to ice coils 11 where part of the vapor is condensed against the cold surface of the coils. This liquid and vapor passes through header 13 to check valves 15 and 16. One of these check valves will be open and allow the liquid and vapor to enter the unpressurized accumulator/pumper where the liquid will separate from the vapor and accumulate in the bottom of the accumulator/pumper. The vapor will exit through line 21 or 22 to DPC valve 43. The piston above the unpressurized accumulator/pumper will be held open by spring 48 and the vapor can flow through line 23 to compressor 24 and condenser 25.

Air pump 45 provides agitation during ice melting, which increases the heat transfer rate between the ice and the coils especially when the ice is almost all melted and the system nears complete discharge.

In the event that there are small evaporators whose capacity is less than the condensing unit capacity in the system, automatic expansion valve 38 is supplied. With only a small evaporator calling for cooling, the condensing unit suction might end up way below freezing and the evaporator would frost. As suction pressure reaches freezing, automatic expansion valve 38 opens and allows ice to build on coils 11 and not on the evaporator. This would be the only time in which ice could build on coils 11 when cooling is being called for.

If accumulator/pumpers A and B were located outside the ice tank, the suction pressure during the off cycle would increase at a greater rate and the compressor would restart more often and result in short-cycling, which is avoided by having the accumulator/pumpers located in the ice tank.

The low pressure control switch 47 is set to a cut out pressure of 38–42 psig and to a cut in pressure of 60 psig, which corresponds to a temperature of about 34° F., which is above freezing. When cooling is called for, the pressure will almost always be above 60 psig, causing the system to refreeze any melted ice when the cooling demand is satisfied. Short cycling is, therefore, avoided.

FIG. 1 shows multiple evaporators 14A, 14B, 14C and 14D, each controlled by a solenoid responsive to the thermostat or other signal. The refrigerant control device 75 for each evaporator provides restriction to liquid flow only to the extent that when all evaporators are operating, each evaporator is supplied with its requirement, plus a little for overfeed. The restrictor should be an orifice or capillary tube. It can be a thermostatic expansion valve, but it requires superheat to control and this reduces the capacity of the evaporator 10–20 percent, compared to the capacity of an overfeed orifice.

FIG. 1 also shows a compressor 24 together with an air cooled condenser 25 to dissipate heat. The air cooled condenser can be replaced with a water cooled condenser or with a heat recovery condenser to recover heat as service hot water for both residential and commercial installations. If service hot water is normally supplied by electric resistance hot water heaters, additional demand charge reductions can be realized by reducing or eliminating electrical demand for water heaters.

Capillary tubes 30 and 31 are used to reduce pressure adiabatically causing the flash gas for providing the pumping. Other adiabatic expansion devices such as orifices or a subcooling expansion valves could also have been illustrated.

From the foregoing description of the preferred embodiments of the invention it will be apparent that many modifications may be made therein without departing from the true spirit and scope of the invention.

What is claimed is:

1. An apparatus for storing energy and for utilizing stored energy comprising:

a storage container for receiving an energy storage material;

a plurality of coils disposed in said storage container; said coils containing a fluid which exists at liquid and vapor states;

at least one evaporator; said evaporator connected to said coils;

a condensing unit; said condensing unit including a compressor and a condenser;

a pumping apparatus; said pumping apparatus connected to said condensing unit, to said evaporator, and to said coils; said pumping apparatus receiving liquid from said condensing unit; means for adiabatically converting said liquid received in said pumping apparatus to flash gas and low temperature liquid, whereby said pumping apparatus moves fluid to said evaporator without the need for additional energy input.

2. An apparatus for storing energy and for utilizing stored energy comprising:

a storage container for receiving an energy storage material;

a plurality of coils disposed in said storage container; said coils containing a fluid which exists at liquid and vapor states;

at least one evaporator; said evaporator connected to said coils;

a condensing unit;

a pumping apparatus; said pumping apparatus connected to said condensing unit, to said evaporator, and to said coils; said pumping apparatus operated by the adiabatic conversion of liquid received from said condensing unit to flash gas and lower temperature liquid, whereby said pumping apparatus moves fluid to said evaporator without the need for additional energy input; said pumping apparatus includes first and second tanks, each of said tanks alternately operating as a pumper during one time period and as an accumulator during another time period.

3. An apparatus as set forth in claim 2 wherein said pair of tanks are at least partly disposed in said storage container.

4. An apparatus as set forth in claim 2 wherein said pumping apparatus includes means for reversing the tanks from accumulator to pumper.

5. An apparatus as set forth in claim 4 wherein said means for reversing includes two pressure activated valves.

6. An apparatus as set forth in claim 5 wherein said pressure activated valves include pistons for opening and closing said valves.

7. An apparatus as set forth in claim 2 further including an adiabatic expansion device connected between said condensing unit and said first tank.

8. An apparatus as set forth in claim 7 wherein said adiabatic expansion device is a capillary tube.

9. An apparatus as set forth in claim 8 further including valve means connected between said condenser and said adiabatic expansion device.

10. An apparatus as set forth in claim 7 further including another adiabatic expansion device connected between said condensing unit and said second tank.

11. An apparatus as set forth in claim 10 wherein said adiabatic expansion device is a capillary tube.

12. An apparatus as set forth in claim 10 further including switch means connected between said condenser and said adiabatic expansion device.

13. An apparatus as set forth in claim 4 further including timing means connected to said reversing means.

14. An apparatus as set forth in claim 1 wherein said compressor is a two speed compressor.

15. An apparatus as set forth in claim 1 further including means for agitating said material in said storage container.

16. A method for regulating the temperature in a conditioned space utilizing a tank containing coils housing refrigerant material and energy storage material, and further utilizing a condensing unit, at least one evaporator, and two accumulator/pumpers, comprising the steps of:

accumulating refrigerant fluid in a portion of one of said accumulator/pumpers; providing liquid refrigerant from said condensing unit;

adiabatically converting at least a portion of refrigerant fluid from said condenser from liquid to gas;

contacting said gas with said refrigerant fluid in said one accumulator/pumper, and pumping said refrigerant fluid in said one of said accumulator/pumpers to said at least one evaporator or to said coils.

17. A method as set forth in claim 16 further including the steps of:

alternately using one of said accumulator/pumpers in its accumulator mode while the other accumulator/pumper is in its pumper mode for predetermined time intervals;

reversing said modes of each of said accumulator/pumpers whereby when said one accumulator/pumper is in its accumulator mode said other accumulator/pumper is in its pumper mode;

18. A method as set forth in claim 16 including the step of agitating the material in said energy storage container during the cooling mode.

19. A method as set forth in claim 16 further including the steps of ceasing contact of gas with said refrigerant fluid in said one accumulator/pumper while substantially simultaneously contacting gas from said condensing unit with refrigerant fluid in said other accumulator/pumper, and pumping said refrigerant fluid from said other accumulator/pumper to said at least one evaporator or said coils while said one accumulator/pumper is not pumping.

* * * * *